US007140845B2

(12) United States Patent
Hsiao

(10) Patent No.: US 7,140,845 B2
(45) Date of Patent: Nov. 28, 2006

(54) PORTABLE AIR COMPRESSOR

(76) Inventor: Eming Hsiao, No. 427, Sec. 2, Doou-Chung Rd., Tien-Chung, Chang-Hwa (TW)

( * ) Notice: Subject to any disclaimer, the term of this patent is extended or adjusted under 35 U.S.C. 154(b) by 643 days.

(21) Appl. No.: 10/635,039

(22) Filed: Aug. 5, 2003

(65) Prior Publication Data

US 2005/0031457 A1 Feb. 10, 2005

(51) Int. Cl.
*F04B 53/00* (2006.01)

(52) U.S. Cl. ..... 417/234

(58) Field of Classification Search ..... 417/234, 417/411, 415; D15/9
See application file for complete search history.

(56) References Cited

U.S. PATENT DOCUMENTS 3,243,100 A * 3/1966 Adams ..... 137/565.18
5,052,894 A * 10/1991 Rimington ..... 417/44.2
5,094,591 A * 3/1992 Whitley et al. ..... 417/234
5,293,707 A * 3/1994 Shaeffer ..... 40/412
5,378,119 A * 1/1995 Goertzen ..... 417/313
2002/0131872 A1* 9/2002 Lucchi ..... 417/234
2003/0102346 A1* 6/2003 Chen ..... 224/675
2003/0195408 A1* 10/2003 Hastings et al. ..... 600/382
2004/0175276 A1* 9/2004 Downes ..... 417/234

* cited by examiner

*Primary Examiner*—Anthony D. Stashick
*Assistant Examiner*—Vikansha Dwivedi
(74) *Attorney, Agent, or Firm*—Alan D. Kamrath; Nikolai & Mersereau, P.A.

(57) ABSTRACT

An air compressor has a housing, a battery, a printed circuit board, a switch, an air compressing device and a belt. The housing is composed of a right cover and a left cover. A battery chamber, a printed circuit board chamber and a compressing device chamber are defined between the right and left covers to respectively receive the battery, the printed circuit board and the air compressing device. A baffle is formed in the housing between the printed circuit board chamber and the compressing chamber. The switch is mounted in and exposed from the housing and electrically connected to the printed circuit board. The belt is attached to the housing, such that a user can conveniently and easily carry the air compressor on the user's body to any desired location for use.

3 Claims, 7 Drawing Sheets

PORTABLE AIR COMPRESSOR

BACKGROUND OF THE INVENTION

1. Field of the Invention

The present invention relates to an air compressor, and more particularly to a portable air compressor that can be conveniently and easily carried to any desired location for use.

2. Description of Related Art

With reference to FIG. 7, an air compressor (60) is used to compress air to a desired high pressure, and the high-pressured air is applied to drive a pneumatic tool. A conventional air compressor (60) substantially comprises a base (not numbered) and a compressing device (not numbered) mounted on the base and for compressing air to a desired high pressure. A hose (62) is attached by one end to a connector of the compressing device and the other end is connected to a pneumatic tool. Accordingly, the high-pressured air is applied to the pneumatic tool through the hose (62).

However, the conventional air compressor (60) has a large volume and a heavy weight, such that to transport the conventional air compressor (60) is very difficult. Therefore, to move the conventional air compressor (60) to another location, such as the second floor or outdoors, is difficult, and the simple though limited solution is a hose (62) with a long length. Therefore, the conventional air compressor (60) is inconvenient in use.

To overcome the shortcomings, the present invention tends to provide an air compressor to mitigate or obviate the aforementioned problems.

SUMMARY OF THE INVENTION

The main objective of the invention is to provide an air compressor that is conveniently and easily carried to any desired location for operation. The air compressor has a housing, a battery, a printed circuit board, a switch, an air compressing device and a belt. The housing is composed of a right cover and a left cover. A battery chamber, a printed circuit board chamber and a compressing device chamber are defined between the right and left covers to respectively receive the battery, the printed circuit board and the air compressing device. A baffle is formed in the housing between the printed circuit board chamber and the compressing chamber. The switch is mounted in and exposed from the housing and electrically connected to the printed circuit board. The belt is attached to the housing, such that a user can conveniently and easily carry the air compressor on the user's body to any desired location for use.

Other objects, advantages and novel features of the invention will become more apparent from the following detailed description when taken in conjunction with the accompanying drawings.

DETAILED DESCRIPTION OF PREFERRED EMBODIMENT

Figure 1:
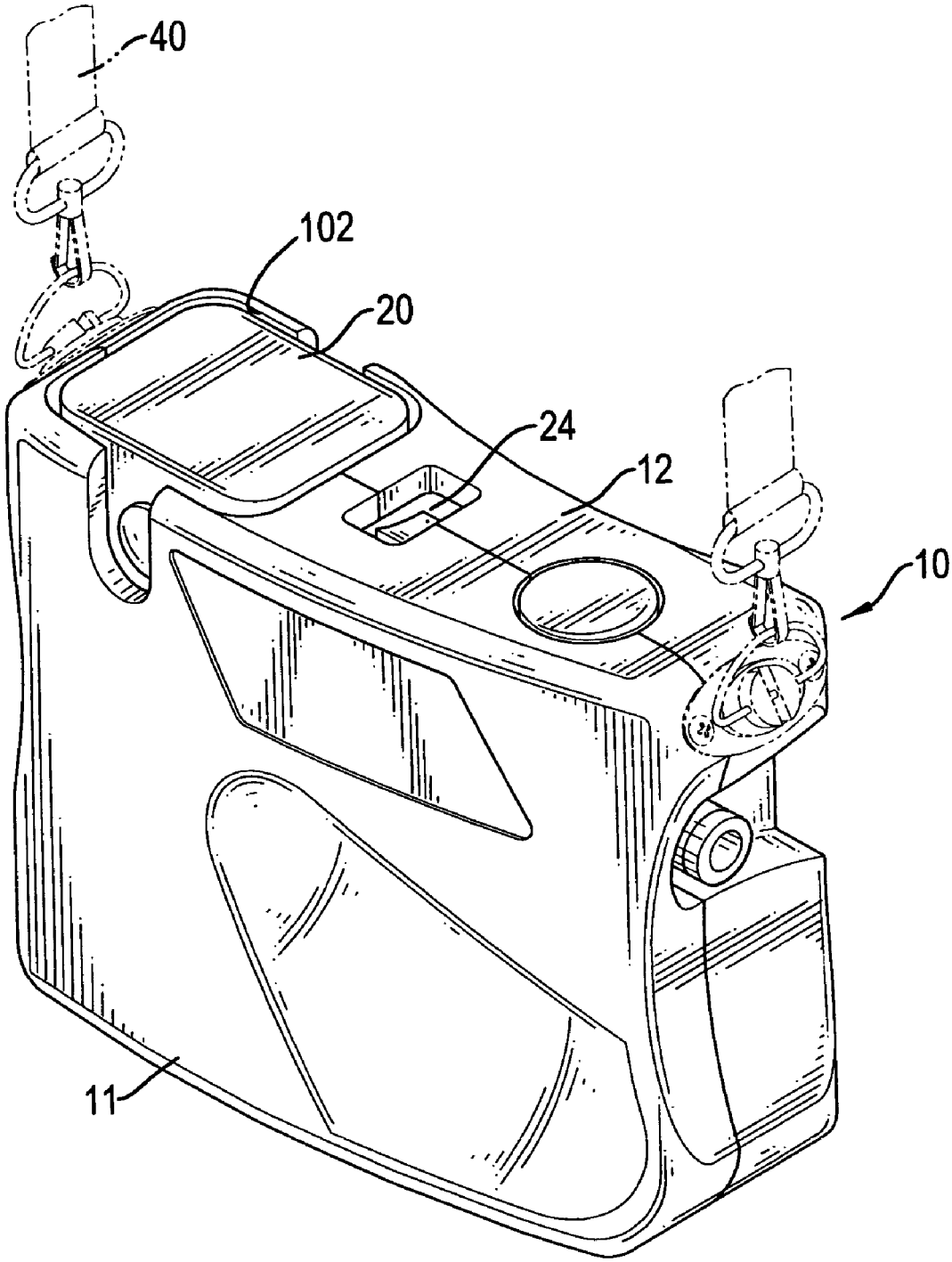
FIG. 1 is a perspective view of an air compressor in accordance with the present invention.
Figure 2:
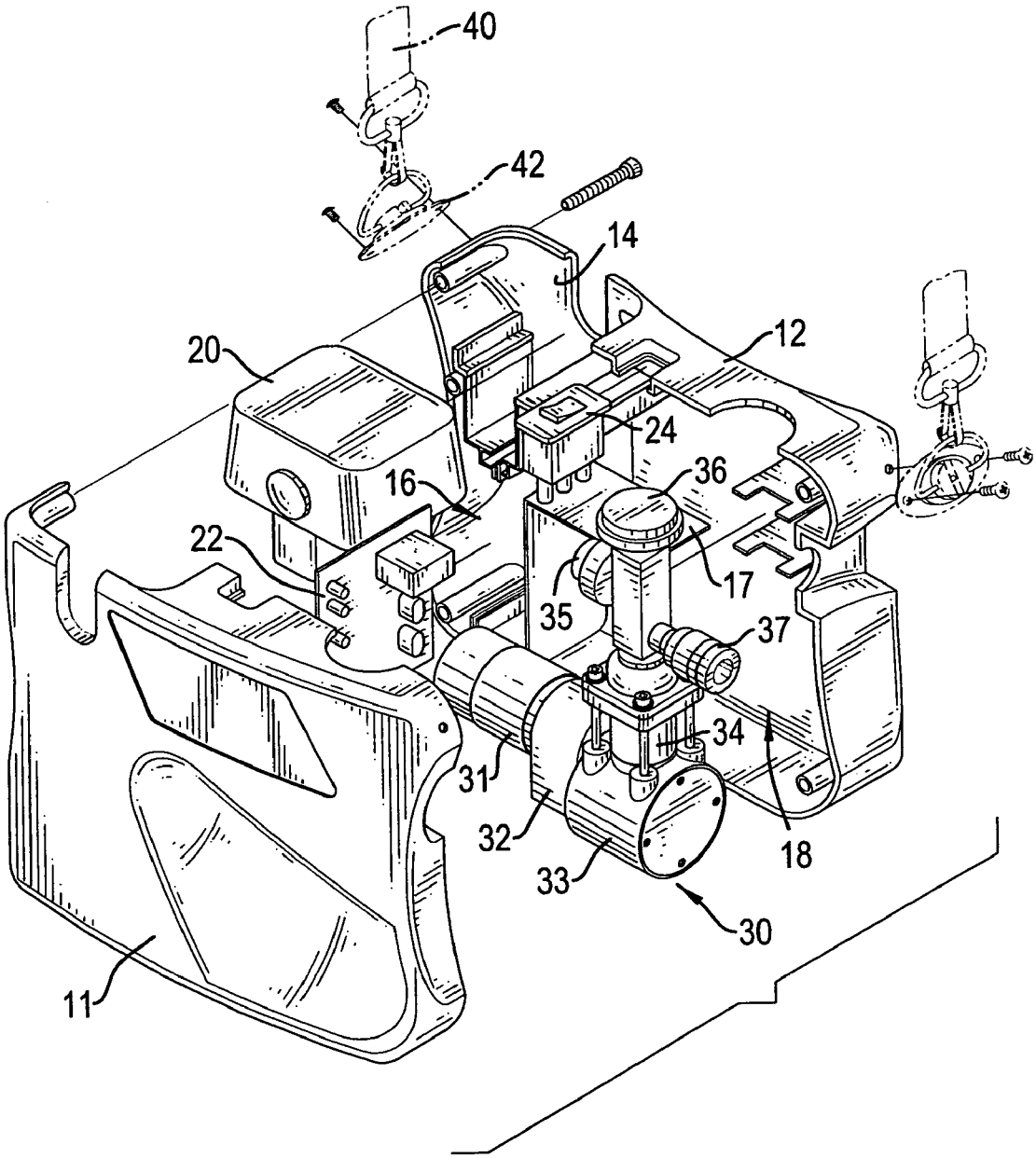
FIG. 2 is an exploded perspective view of the air compressor in FIG. 1.
Figure 3:
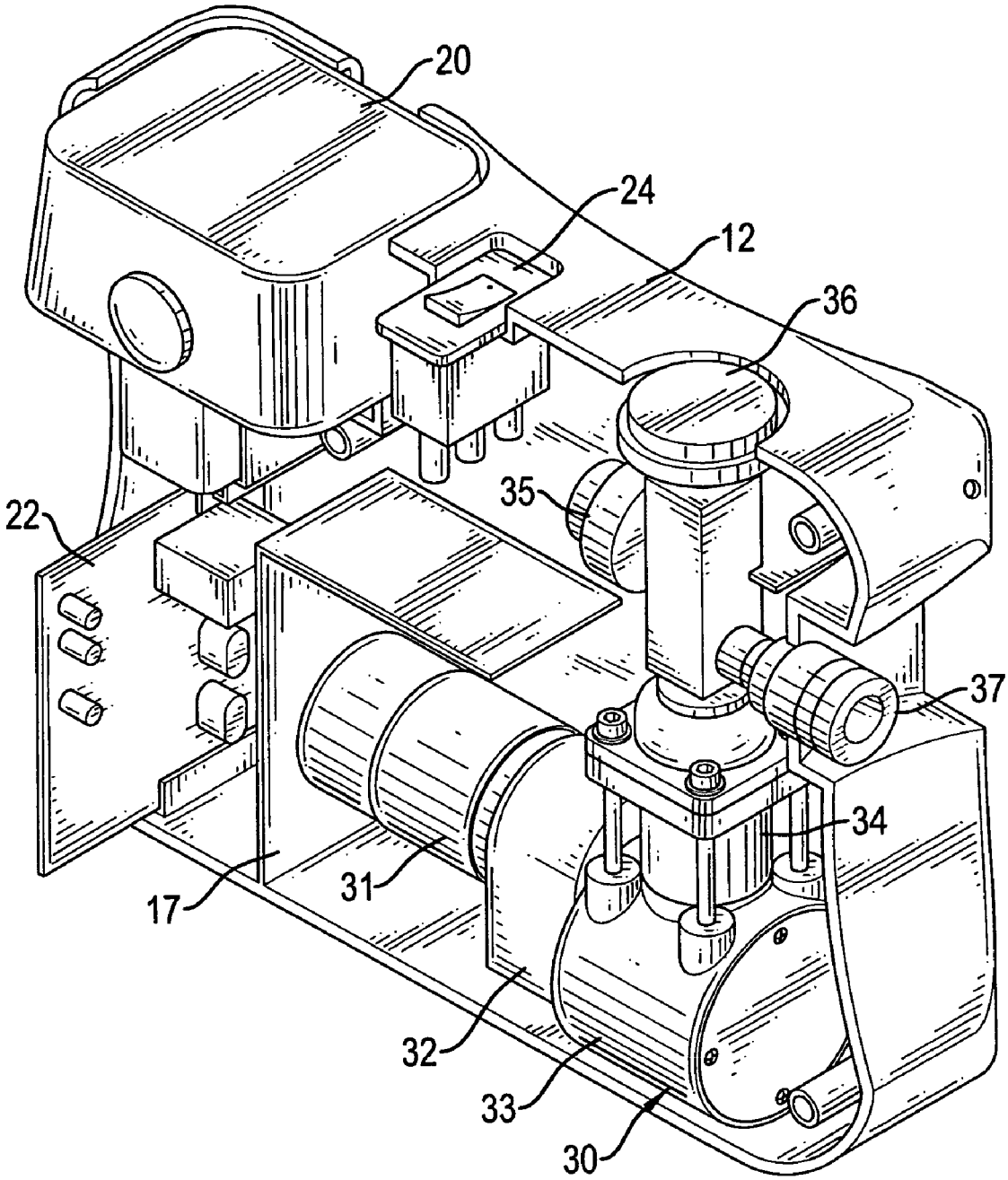
FIG. 3 is a perspective view of an internal structure of the air compressor in FIG. 1.

With reference to FIGS. 1 to 3, an air compressor in accordance with the present invention comprises a housing (10), a battery (20), a printed circuit board (22), an air compressing device (30), a switch (24) and a belt (40). The housing (10) is composed of a right cover (11) and a left cover (12). The right cover (11) and the left cover (12) are combined together with bolts. The housing (10) has a battery chamber (14), a printed circuit board chamber (16) and a compressing device chamber (18) defined between the right and left covers (11, 12). The printed circuit board chamber (16) is adjacent to the battery chamber (14), and the compressing device chamber (18) is adjacent to the compressing chamber (16). The housing (10) further has an opening (102) communicating the battery chamber (14) and a baffle (17) formed in the housing (10) between the printed circuit board chamber (16) and the compressing chamber (18).

The battery (20) is received in the battery chamber (14) through the opening (102) in the housing (10). The printed circuit board (22) is received in the printed circuit board chamber (16) and has a circuit electrically connected to the battery (20).

The air compressing device (30) is received in the compressing chamber (18) and is electrically connected to the circuit of the printed circuit board (22) for compressing air to a desired high pressure. The air compressing device (30) comprises a motor (31), a gear box (32), a crank case (33) and a cylinder (34). The motor (31) is electrically connected to and actuated by the circuit on the printed circuit board (22), and the motor (31) has an output shaft (not shown). The gear box (32) is attached to the output shaft of the motor (31) and has a transmission device (not shown) connected to the output shaft of the motor (31). In practice, the transmission device comprises multiple gears engaging with each other, and one of the gears is attached to and is rotated with the output shaft. With the arrangement of the gear box (32), the output rotating speed will is reduced.

The crank case (33) is attached to the gear box (32) and has a crank device (not shown) connected to and driven by the transmission device of the gear box (32). The cylinder (34) is connected to and driven by the crank device of the crank case (33) to compress the air to a desired high pressure. A pressure gauge (36) is connected to the cylinder (34) and is exposed from the housing (10) to show the pressure level of the compressed air. A pressure switch (35) is connected to the cylinder (34). A hose connector (37) is connected to the cylinder (34) and is exposed from the housing (10) so as to connect with a hose (not shown), such that the compressed air can be fed to a pneumatic tool through the hose.

The switch (24) is mounted on and exposed from the housing (10) and is electrically connected to the circuit on the printed circuit board (22). When the switch (24) is turned on, the electrical power provided by the battery (20) is sent to the motor (31) through the circuit on the printed circuit board (22) to drive the motor (31) to rotate. The cylinder (34) will be driven to compress air to a high pressure level with the transmission of the transmission device in the gear box (32) and the crank device in the crank case (33).

The belt (40) is attached to the housing (10) for a user to carry the air compressor. In a first embodiment, the belt (40) comprises a strap with two ends. The housing (10) has two belt connectors (42) respectively mounted on two ends of the housing (10), and two ends of the belt (40) are respectively connected to the belt connectors (42) on the housing (10).

Figure 4:
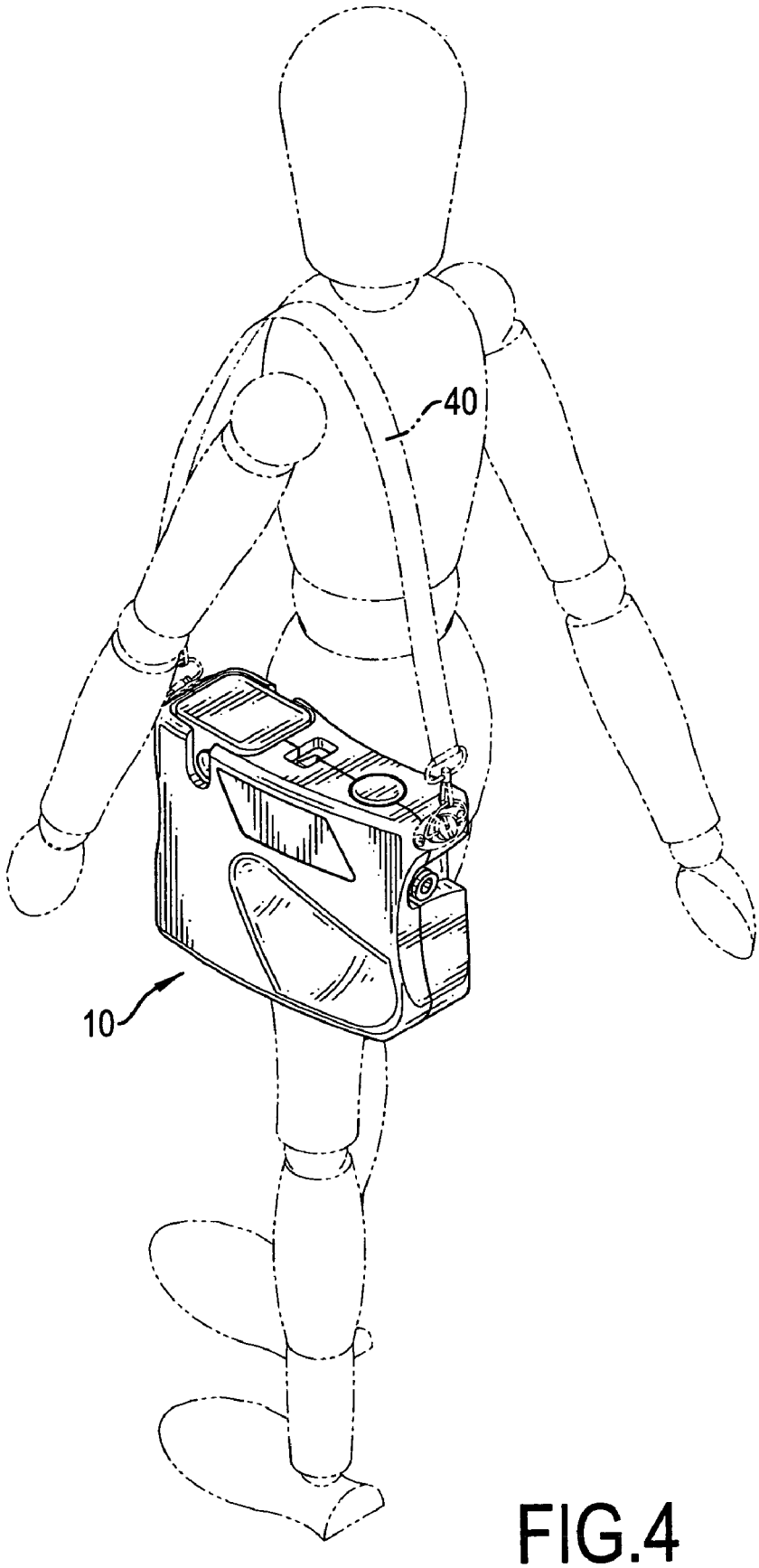
FIG. 4 is a perspective view of a first operational embodiment of the air compressor in accordance with the present invention.
Figure 5:
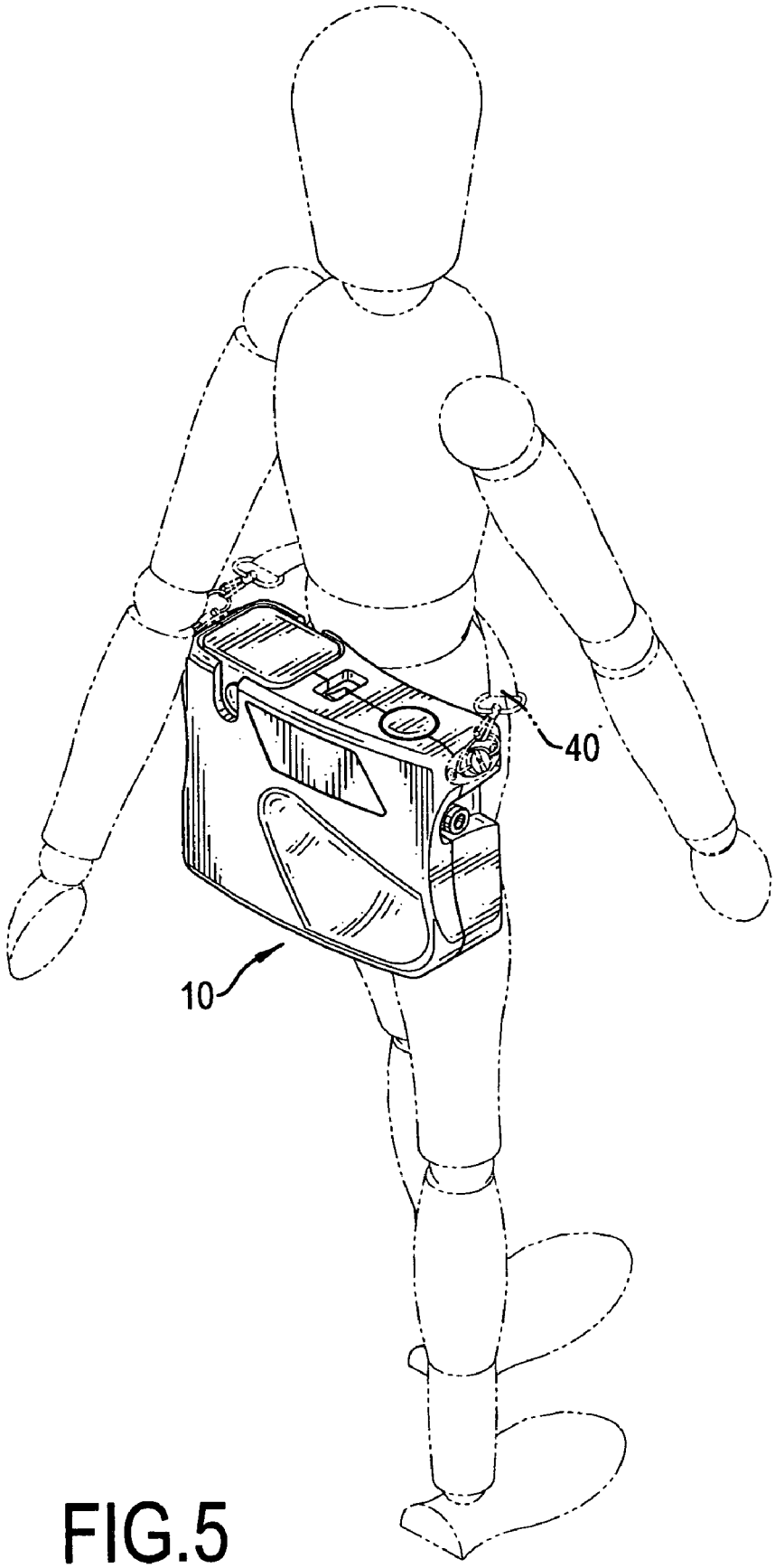
FIG. 5 is a perspective view of a second operational embodiment of the air compressor in accordance with the present invention.

Accordingly, with reference to FIGS. 4 and 5, the user can carry the housing from the shoulder or waist. Therefore, the air compressor in accordance with the present invention can be easily and conveniently carried to any desired location for use, and a hose with a long length is not needed. The use of the portable air compressor is versatile.

Figure 6:
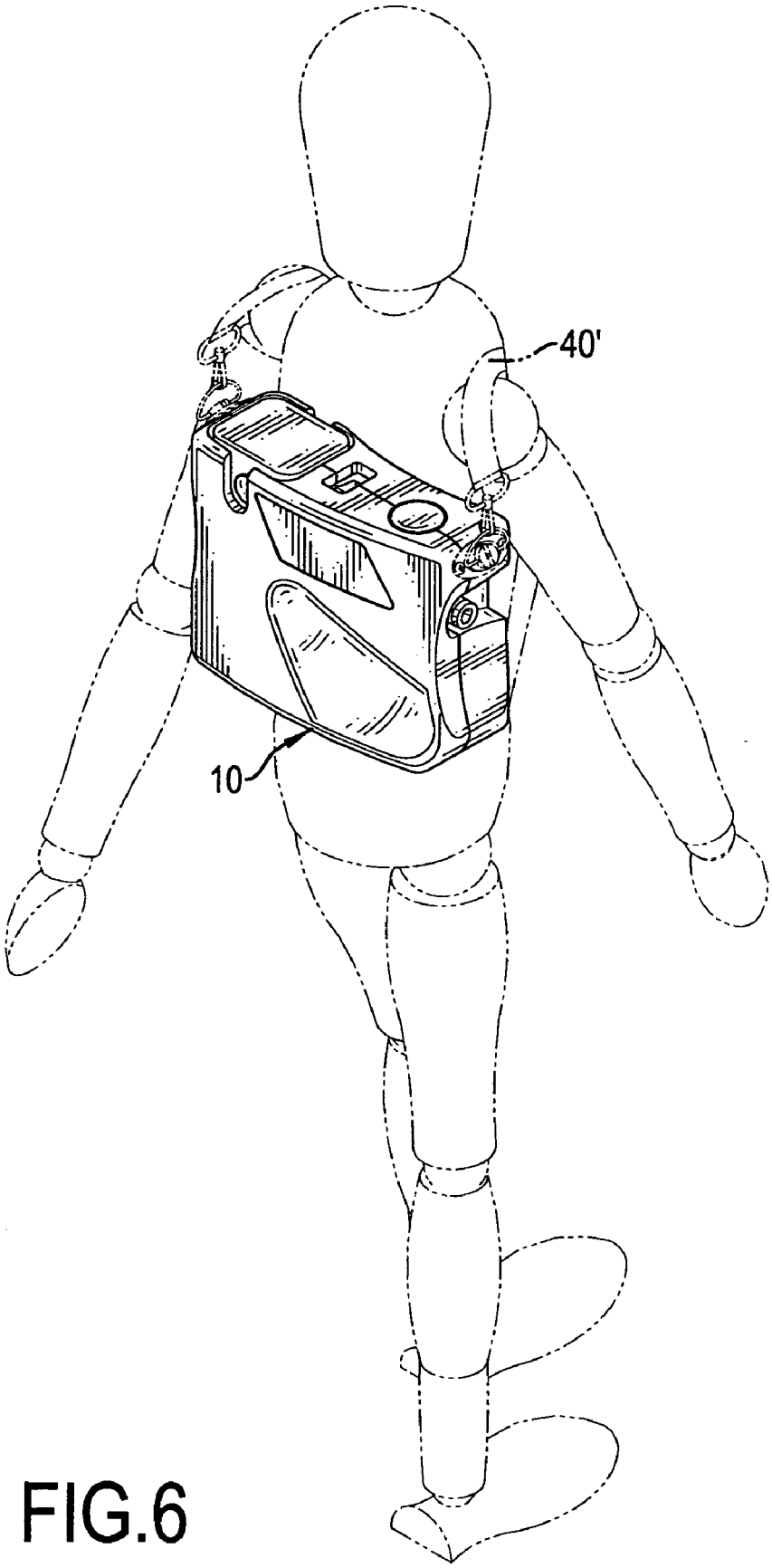
FIG. 6 is a perspective view of a third operational embodiment of the air compressor in accordance with the present invention.
Figure 7:
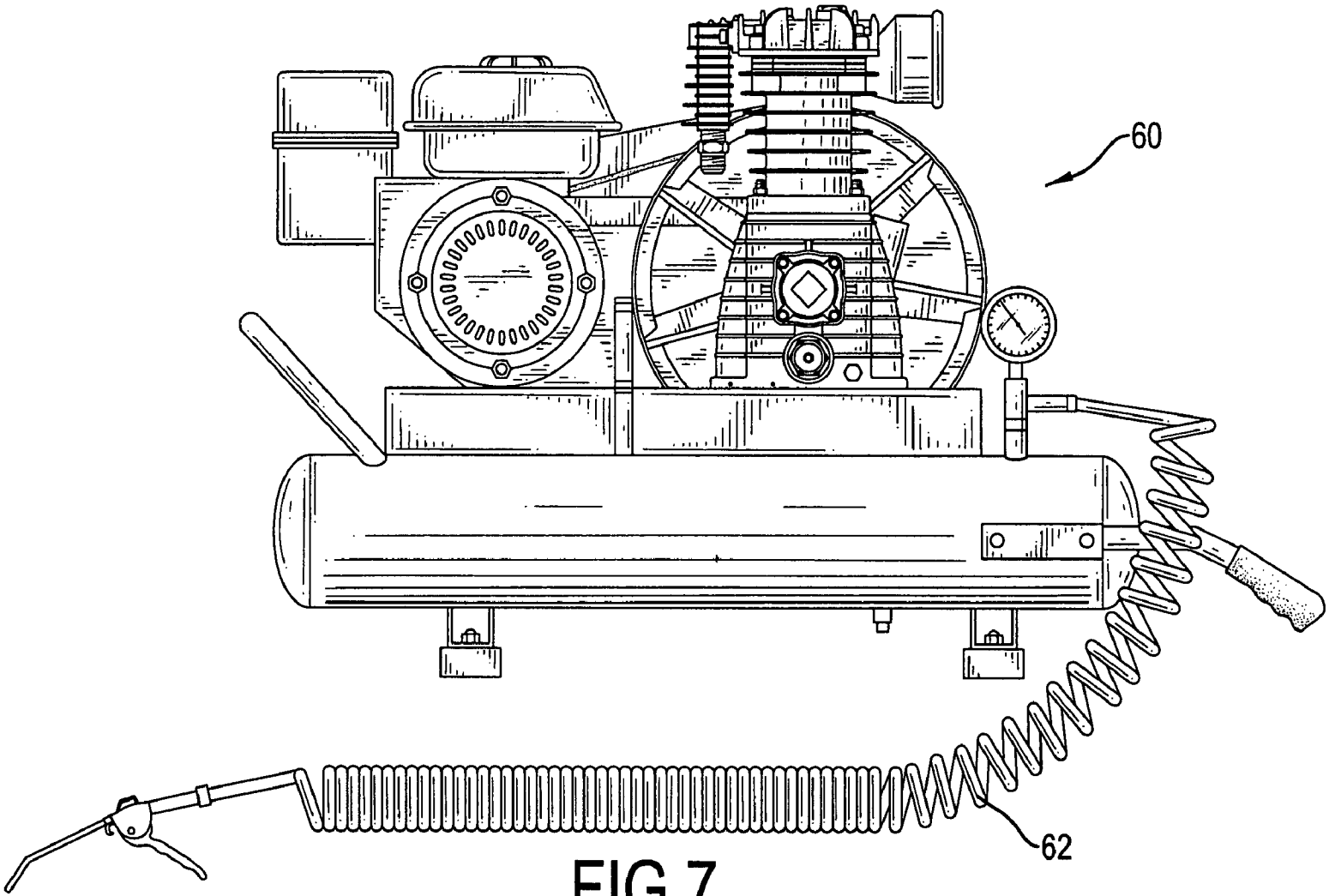
FIG.7 PRIOR ART
FIG. 7 is a side plan view of a conventional air compressor with a hose in accordance with the prior art.

With reference to FIG. 6, in another embodiment, the belt (40') comprises two straps respectively attached to the top and bottom edges of the housing (10). With such a belt (40'), the user can carry the air compressor on the shoulders as a knapsack for conveniently transporting the air compressor.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An air compressor comprising:

a housing composed of a right cover and a left cover and having:

a battery chamber defined between the right and left covers;

a printed circuit board chamber defined between the right and left covers and adjacent to the battery chamber;

a compressing device chamber defined between the right and left covers and adjacent to the circuit board chamber;

an opening defined in the housing and communicating with the battery chamber; and a baffle formed in the housing between the printed circuit board chamber and the compressing device chamber;

a battery received in the battery chamber;

a printed circuit board received in the printed circuit board chamber and having a circuit electrically connected to the battery;

a switch mounted on and exposed from the housing and electrically connected to the circuit on the printed circuit board;

an air compressing device received in the compressing device chamber and electrically connected to the circuit on the printed circuit board for compressing air to a desired high pressure; and a belt attached to the housing.

2. The air compressor as claimed in claim 1, wherein the air compressing device further comprises:

a motor electrically connected to and actuated by the circuit on the printed circuit board and having an output shaft;

a gear box with a transmission device attached to the output shaft of the motor;

a crank case attached to the gear box and having a crank device connected to the transmission device of the gear box;

a cylinder connected to and actuated by the crank device of the crank case to compress the air to a desired high pressure;

a pressure gauge connected to the cylinder and exposed from the housing;

a pressure switch connected to the cylinder; and a hose connector connected to the cylinder and exposed from the housing.

3. The air compressor as claimed in claim 1, wherein the housing has two belt connectors respectively mounted on two ends of the housing; and the belt comprises a strap with two ends respectively connected to the belt connectors on the housing.

* * * * *